US005256120A

United States Patent [19]

Howell

[11] Patent Number: 5,256,120

[45] Date of Patent: Oct. 26, 1993

[54] JUMP ROPE SPRINKLER

[76] Inventor: Byron H. Howell, 3145 Market, East St. Louis, Ill. 62207

[21] Appl. No.: 911,899

[22] Filed: Jul. 10, 1992

[51] Int. Cl.[5] ..... A63B 5/20

[52] U.S. Cl. ..... 482/82; 472/128

[58] Field of Search ..... 482/81, 82; 4/615; 472/128

[56] References Cited

U.S. PATENT DOCUMENTS

| | | | |
|---|---|---|---|
| 2,580,626 | 1/1952 | Warren . | |
| 2,665,171 | 1/1954 | Stievater . | |
| 3,064,972 | 11/1962 | Felnn | 482/81 |
| 3,107,916 | 10/1963 | Cooper | 482/81 |
| 3,170,171 | 2/1965 | Mayhew et al. . | |
| 3,322,347 | 5/1967 | Pierce . | |
| 3,326,551 | 6/1967 | Clarke . | |
| 3,363,898 | 1/1968 | Crovello | 482/82 |
| 3,481,600 | 12/1969 | Lang et al. . | |
| 3,958,802 | 5/1976 | Thornton | 482/81 |
| 4,124,206 | 11/1978 | Price . | |
| 4,315,623 | 2/1982 | Granderson | 482/81 |
| 4,498,627 | 2/1985 | Arginsky . | |
| 5,070,552 | 12/1991 | Gentry et al. | 4/615 |

*Primary Examiner*—Richard J. Apley
*Assistant Examiner*—Jeanne M. Mollo
*Attorney, Agent, or Firm*—Polster, Lieder, Woodruff & Lucchesi

[57] ABSTRACT

A jump rope sprinkler for use by a single user includes a rigid tube held by the user for rotation around its long axis. One end of the rigid tube has a swivel attached by a barb to a feed hose whose other end includes a standard hose fitting. The ends of a flexible perforated tube are attached to the rigid tube adjacent the ends of the rigid tube in fluid communication with the feed hose to form a U-shaped spray tube.

17 Claims, 1 Drawing Sheet

JUMP ROPE SPRINKLER

BACKGROUND OF THE INVENTION

This invention relates to an amusement device and in particular to a hand-held device which provides both exercise and cooling.

Numerous aerobic exercise devices are known, but none is simpler and provides better exercise than a jump rope.

Numerous other devices have been devised which combine a water sprinkler or spray with some sort of game or individual recreation.

It has been proposed in the past to provide a water spray device which is formed as a jump rope with holes in it to spray water on the user. Examples of such devices are Cooper, U.S. Pat. No. 3,107,916; Lang et al., U.S. Pat. No. 3,481,600; and price, U.S. Pat. No. 4,124,206. These devices have been complex and expensive, they have required substantial room, and they have generally required at least two persons to operate them.

SUMMARY OF THE INVENTION

One of the objects of this invention is to provide a sprinkling jump rope which provides both excellent aerobic exercise and cooling for a user.

Another object is to provide such a jump rope which is far simpler and less expensive to manufacture than those known previously.

Another object is to provide such a jump rope which is simple to use.

Another object is to provide such a jump rope which is compact and may be used by a single person.

Other objects will be apparent to those skilled in the art in light of the following description and accompanying drawings.

In accordance with the present invention, generally stated, a jump rope sprinkler is provided including a rigid tube which is held by the user for rotation around its long axis. One end of the tube is attached to a water hose through a swivel. The ends of a perforated, flexible tube are attached to the rigid tube, with at least one of the ends in fluid communication with the water hose to form a U-shaped spray tube.

Because the ends of the perforated tube are supported by the rigid tube which is held by the user, no internal support is needed in the flexible tube as is required in prior art jump rope sprinklers. In the preferred embodiments, the ends of the flexible tube are fixed with respect to the rigid tube and rotate with it.

In the preferred embodiment, one end of the spray tube is attached to a barb at the swivel end of the rigid tube, and the other end of the spray tube extends into the other end of the rigid tube, through a friction clip. This arrangement allows the length of the U-shaped spray tube to be adjusted to suit each individual user.

To use the jump rope of the present invention, the user grasps the rigid tube in both hands and rotates the U-shaped spray tube around his or her body as a jump rope. Water in the spray tube is sprayed through the perforations onto the user in a fine mist.

Other features of the invention are best understood in the light of the following description of the preferred embodiment.

DESCRIPTION OF THE PREFERRED EMBODIMENT

Figure 1:
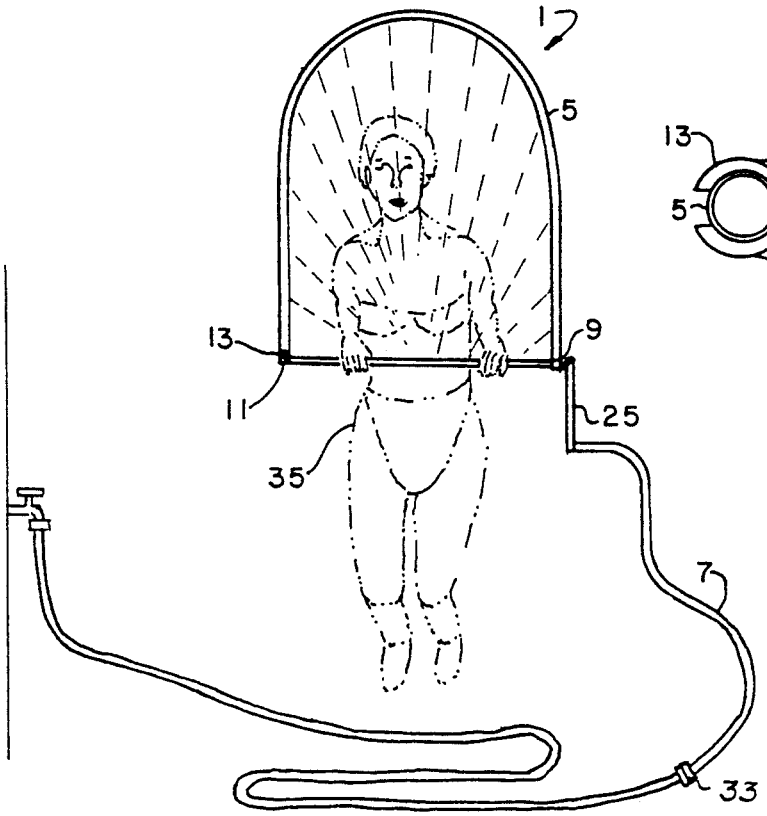
FIG. 1 is a view in perspective of a jump rope sprinkler of the present invention in use.
Figure 3:
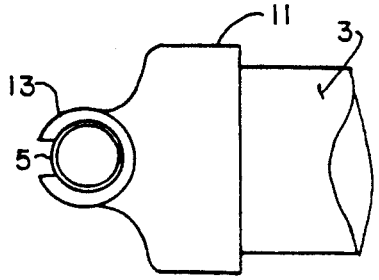
FIG. 3 is a detail of one end of a rigid tube member of the jump rope of FIGS. 1 and 2.
Figure 2:
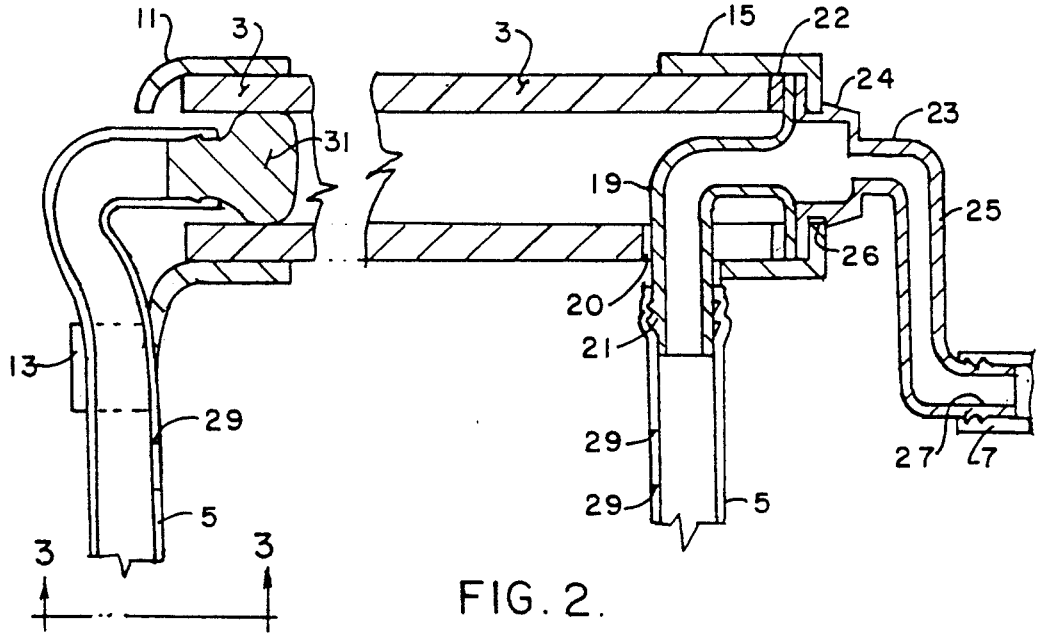
FIG. 2 is a view in front elevation, partially broken away, of the jump rope of FIG. 1.

Referring now to the drawings, and in particular to FIG. 1, reference numeral 1 indicates one illustrative embodiment of a jump rope sprinkler of the present invention. The jump rope 1 includes a rigid tube 3, a flexible, perforated tube 5, a feed hose 7, and a swivel 9 between the feed hose 7 and the rigid tube 3.

The rigid tube 3 is made of a plastic material such as polyvinyl chloride (PVC). The material and its wall thickness are chosen to ensure that the tube 3 is self-supporting in use. The tube 3 is preferably about 0.7" to 1.2" in diameter and about twenty to forty inches long, the diameter and length being chosen to permit easy use by persons of various ages and sizes.

At one end of the rigid tube 3 an open-ended plastic cap 11 is provided. The cap 11 includes a clip 13, for purposes described hereinafter.

At the other end of the rigid tube 3, a second cap 15 is provided. The second cap 15 is provided with a standard liquid-carrying swivel 9, extending axially from the end of the rigid tube 3. The exact internal structure of the swivel 9 is not 10 critical to the invention, many suitable swivels being known in the art. The illustrative swivel includes a first internal part 19 having at one end a 90° bend terminating in a standard hollow barb 21 which extends through a slot 20 in the side wall of the rigid tube 3. A relatively rotatable second internal part 23 of the swivel 9 extends axially from the end of the rigid tube 3. An elastomeric washer 22 seals the first internal part 19 to the end of the rigid tube 3. The second internal part 23 includes a tapered flange 24 which is snap fit into a central opening 26 in the cap 15 and forms a rotatable fit with the opening 26. The second internal part 23 includes at its free end an offset 25 which is attached to a first end of the feed hose 7 by a hollow barb 27 The offset 25 acts to reduce any tendency of the feed hose 7 to rotate with the rigid tube 3.

The perforated tube 5 is formed of a flexible plastic material, such as PVC, with small punctures 29 in it. The perforated tube 5 is preferably about six to nine feet long and has a diameter substantially smaller than the diameter of the rigid tube 3. The punctures preferably are on only one side of the tube, which is chosen to face inward when the perforated tube 5 is attached to the rigid tube 3. The punctures are preferably small enough to produce a fine mist when line-pressure water is introduced into the tube 5.

One end of the perforated tube 5 is attached to the barb 21, and the other end includes a closed fitting 31 which is sized to make a tight fit in the interior of the rigid tube 3. The end of the perforated tube 5 with the fitting 31 is pushed through the cap 11 into the end of the rigid tube 3 to adjust the length of the perforated tube 5 to suit the user, and the perforated tube 5 is then clipped into the clip 13 to hold its length constant during use.

The feed hose may be any length, although it is preferably about four to ten feet long to permit it to be attached at some distance to a garden hose or directly to a faucet. The free end of the feed hose 7 includes a standard female hose fitting 33, for attachment to a standard garden hose or household outdoor faucet.

In use, the free end of the perforated hose is loosened from the clip 13 and the perforated hose is pushed farther into or pulled farther out of the rigid tube to adjust the length of the perforated tube to the user. Most users prefer the U-shaped jump rope part formed by the perforated tube to touch the ground when the rigid tube 3 is held between waist and chest high.

When water is turned on, it flows through the feed hose 7, through the swivel 9, into the flexible perforated hose 5, and through the punctures 29 and onto the user 35 in a fine mist. If the swivel 9 is not perfectly water tight, it may also produce a spray. The user 35 holds the rigid tube 3 horizontal in both hands and allows the tube 3 to rotate while swinging the U-shaped flexible perforated tube 5 around his or her body in a standard rope jumping motion.

Numerous variations in the jump rope sprinkler of the present invention, within the scope of the appended claims will occur to those skilled in the art in light of the foregoing disclosure. Merely by way of example, the end of the perforated tube opposite the swivel may be made open, and water may be directed through the swivel into the rigid tube, so that the rigid tube acts as a manifold. This arrangement adds the weight of the water in the rigid tube to the device in use, and it also requires draining the rigid tube after use to prevent spilling the water contained in the rigid tube.

If adjustment of the length of the perforated tube is not desired, the cap opposite the swivel may be made a closed-end cap and barb connectors may be provided for both ends of the perforated tube.

The swivel may be of any standard construction, and the offset may be eliminated to further reduce the cost of the device.

The perforations may be sized to produce a coarser or finer spray, and they may be made to face in directions other than toward the user.

The perforated tube may be attached to the end caps, and the end caps may be made rotatable with respect to the rigid tube. In this arrangement, the alignment of the flexible tube is lost when the device is not in use, but water pressure and centrifugal force will quickly align it in use.

The rigid tube may be provided with one or more rotatable 10 sleeves to act as handgrips for the user as shown in U.S. Pat. No. 4,315,623. This modification simplifies rotation of the U-shaped loop.

These variations are merely illustrative.

I claim:

1. A jump rope sprinkler comprising a rigid tube adapted to be held by a user for rotation around its long axis, the rigid tube having a first end and a second end; a water hose; swivel means at the first end of the rigid tube for attaching the rigid tube to the water hose; and a flexible perforated tube having first and second ends, the ends of the perforated tube being attached to the rigid tube adjacent the ends of the rigid tube in fluid communication with the water hose to form a U-shaped spray tube, the perforated tube being attached to the rigid tube for rotation with the rigid tube, the first end of the spray tube being attached to a barb at the first end of the rigid tube, and the second end of the spray tube extending into the second end of the rigid tube.

2. The jump rope sprinkler of claim 1 wherein the rigid tube is of larger diameter than the perforated tube.

3. The jump rope sprinkler of claim 1 further including clip means at the second end of the rigid tue for releasably holding the flexible tue to adjust the length of the flexible tube extending into the rigid tube, hence the length of the U-shaped spray tube.

4. A jump rope sprinkler comprising a rigid tube adapted to be held by a user for rotation around its long axis, the rigid tube having a first end and a second end; a water hose; swivel means at the first end of the rigid tube for attaching the rigid tue to the water hose; and a flexible perforated tube having first and second ends, the ends of the perforated tube being attached to the rigid tube adjacent the ends of the rigid tube in fluid communication with the water hose to form a U-shaped spray tube, the swivel including a part extending axially into the rigid tube, the part extending axially into the rigid tube including an offset external of the rigid tube, the offset being attached to the water hose.

5. A jump rope sprinkler comprising a rigid tube adapted to be held by a user for rotation around its long axis, the rigid tube having a first end and a second end; a water hose; swivel means at the first end of the rigid tube for attaching the rigid tube to the water hose; and a flexible perforated tube having first and second ends, the ends of the perforated tube being attached to the rigid tube adjacent the ends of the rigid tube in fluid communication with the water hose to form a U-shaped spray tube the swivel including a part extending axially into the rigid tube, the swivel including a barb part extending radially through a side wall of the rigid tube, the barb part being in fluid communication with and rotatable with respect to the axially extending part.

6. The jump rope sprinkler of claim 5 wherein the perforated tube includes perforations sized to produce a mist.

7. The jump rope sprinkler of claim 5 wherein the perforated tube includes perforations positioned to spray the user.

8. A jump rope sprinkler for use by a single user, the jump rope sprinkler comprising a substantially straight, rigid tube adapted to be held by the single user for rotation around its long axis, the rigid tube having a first end and a second end; a feed hose having a first end and a second end, the first end of the feed hose including a standard female hose fitting; swivel means at the first end of the rigid tube for forming a rotatable connection between the rigid tube and the second end of the feed hose, the swivel means including hollow barb means for attachment to the second end of the feed hose; a flexible perforated tube having first and second ends, the ends of the perforated tube being attached to the rigid tube adjacent the ends of the rigid tube in fluid communication with the feed hose to form a U-shaped spray tube.

9. The jump rope sprinkler of claim 8 wherein the rigid tube is of larger diameter than the perforated tube.

10. The jump rope sprinkler of claim 8 wherein the perforated tube is attached to the rigid tube for rotation with the rigid tube.

11. The jump rope sprinkler of claim 10 wherein the first end of the spray tube is attached to a hollow barb at the first end of the rigid tube.

12. The jump rope sprinkler of claim 11 wherein the second end of the spray tube extends into the second end of the rigid tube, the jump rope sprinkler further including clip means at the second end of the rigid tube for releasably holding the flexible tube to adjust the length of the flexible tube extending into the rigid tube, hence the length of the U-shaped spray tube.

13. The jump rope sprinkler of claim 8 wherein the swivel includes a part extending axially into the rigid tube.

14. The jump rope sprinkler of claim 13 wherein the part extending axially into the rigid tube includes an offset external of the rigid tube, the offset being attached to the water hose.

15. The jump rope sprinkler of claim 13 wherein the swivel includes a second hollow barb extending radially through a side wall of the rigid tube, the second hollow barb being in fluid communication with and rotatable with respect to the axially extending part.

16. The jump rope sprinkler of claim 8 wherein the perforated tube includes perforations positioned to spray the user.

17. A jump rope sprinkler comprising (a) a substantially straight rigid tube adapted to be held by a user for rotation around its long axis, the rigid tue having a first end and a second end;

(b) a feed hose;

(c) a flexible perforated tube having first and second ends;

(d) first cap means mounted on the first end of the rigid tube for holding the first end of the flexible perforated tube; and (e) second cap means mounted on the second end of the rigid tube for holding the second end of the flexible perforated tube and for forming a rotatable connection with the feed hose, the second cap means including first hollow barb means for attachment to the second end of the flexible perforated tube, a cap having a central opening coaxial with the rigid tube, and rotatable swivel means within the cap, the swivel means including second hollow barb means extending through the central opening for attachment to the feed hose.

* * * * *

UNITED STATES PATENT AND TRADEMARK OFFICE

CERTIFICATE OF CORRECTION

PATENT NO. : 5,256,120
DATED : October 26, 1993
INVENTOR(S) : Byron H. Howell

It is certified that error appears in the above-indentified patent and that said Letters Patent is hereby corrected as shown below:

Column 4, Line 4, 5, 12 delete "tue" and insert -- tube --
Column 6, Line 3 delete "tue" and insert -- tube --

Signed and Sealed this

Fifteenth Day of November, 1994

Bruce Lehman

*Attest:*

BRUCE LEHMAN

*Attesting Officer*

*Commissioner of Patents and Trademarks*